US010974862B2

(12) United States Patent
Hörenbaum

(10) Patent No.: US 10,974,862 B2
(45) Date of Patent: Apr. 13, 2021

(54) FOLDING BOX MADE OF CARDBOARD

(71) Applicant: M+C Schiffer GmbH, Neustadt/Wied (DE)

(72) Inventor: Markus Hörenbaum, Asbach (DE)

(73) Assignee: M+C Schiffer GmbH

( * ) Notice: Subject to any disclaimer, the term of this patent is extended or adjusted under 35 U.S.C. 154(b) by 0 days.

(21) Appl. No.: 16/485,196

(22) PCT Filed: Feb. 15, 2018

(86) PCT No.: PCT/EP2018/053782
§ 371 (c)(1),
(2) Date: Aug. 12, 2019

(87) PCT Pub. No.: WO2018/149918
PCT Pub. Date: Aug. 23, 2018

(65) Prior Publication Data

US 2019/0359371 A1 Nov. 28, 2019

(30) Foreign Application Priority Data

Feb. 15, 2017 (DE) ..... 10 2017 001 534.1

(51) Int. Cl.
*B65D 5/20* (2006.01)
*B65D 5/50* (2006.01)

(52) U.S. Cl.
CPC ..... *B65D 5/20* (2013.01); *B65D 5/5004* (2013.01)

(58) Field of Classification Search
CPC ..... B65D 5/20; B65D 5/5004; B65D 5/50; B65D 25/107; B65D 5/5445; B65D 5/54; B65D 5/328; B65D 5/5011; B65D 5/32
(Continued)

(56) References Cited

U.S. PATENT DOCUMENTS 2,324,232 A 7/1943 Pantalone
3,047,204 A 7/1962 Wolowicz
(Continued)

FOREIGN PATENT DOCUMENTS

DE 3905776 A1 9/1990
DE 9316490.4 U1 3/1994
(Continued)

*Primary Examiner* — J. Gregory Pickett
*Assistant Examiner* — Jennie Pagan
(74) *Attorney, Agent, or Firm* — The Webb Law Firm

(57) ABSTRACT

A folding box made of cardboard includes a blank which forms four lateral surfaces, a cover, and a base of a cuboid and which includes four main folding lines which divide the blank into four main surfaces and a securing surface. Each of the main surfaces has a main surface segment, which forms a respective lateral surface of the cuboid after the securing surface is secured to the opposite main surface, and multiple auxiliary folding lines, which run transversely to the main folding lines and each of which connects one of the main surface segments to an auxiliary surface segment. The auxiliary surface segments form the cover and the base of the cuboid. At least one of the auxiliary surface segments has a plurality of gaps between enclosed parallel webs and a folding line which runs over the auxiliary surface segment orthogonally to the webs and in which the auxiliary surface segment can be folded such that multiple receiving compartments that protrude from the base side are formed by the webs within the folding box. Accordingly, an improved folding box which is suitable for receiving, positions, and presenting goods, in particular toothbrushes in blister packs, is provided.

8 Claims, 5 Drawing Sheets

(58) Field of Classification Search
USPC ..... 206/736, 485, 562, 564, 756, 757, 763, 206/765, 774
See application file for complete search history.

(56) References Cited

U.S. PATENT DOCUMENTS

| | | | | | |
|---|---|---|---|---|---|
| 3,165,200 | A * | 1/1965 | Hanson | B65D 5/5088 | 206/779 |
| 3,314,530 | A * | 4/1967 | Michalka | B65D 5/504 | 206/756 |
| 4,363,400 | A * | 12/1982 | Lewis | B65D 5/10 | 206/562 |
| 5,465,834 | A | 11/1995 | Sieber et al. | | |
| 5,769,228 | A * | 6/1998 | Wroblewski | B65D 75/36 | 206/461 |
| 6,431,363 | B1 * | 8/2002 | Hacker | B65D 5/5038 | 206/486 |
| 2016/0318655 | A1 * | 11/2016 | Lu | B65D 5/5445 | |

FOREIGN PATENT DOCUMENTS

| | | | |
|---|---|---|---|
| DE | 102009042171 | A1 | 3/2011 |
| EP | 0650896 | A1 | 5/1995 |
| EP | 1371567 | A2 | 12/2003 |
| GB | 384237 | | 12/1932 |
| GB | 2511728 | A | 9/2014 |
| WO | 03035487 | A1 | 5/2003 |

* cited by examiner

FOLDING BOX MADE OF CARDBOARD

CROSS-REFERENCE TO RELATED APPLICATIONS

This application is the United States national phase of International Application No. PCT/EP2018/053782 filed Feb. 15, 2018, and claims priority to German Patent Application No. 10 2017 001 534.1 filed Feb. 15, 2017, the disclosures of each of which are hereby incorporated by reference in their entireties.

BACKGROUND OF THE INVENTION

Field of the Invention

The present invention refers to a folding box made of cardboard, consisting of a blank which forms four lateral surfaces and the lid and base of a cuboid, and to a packaging unit for blister packs, in particular blister packs containing toothbrushes, comprising such a folding box.

Description of Related Art

Cuboid folding boxes made of cardboard are generally known as packaging, the cuboid being formed by folding a blank. The blank usually comprises several surface segments which are separated from each other by folding lines which form the edges of the cuboid. In most cases, a fastening tab formed onto one side of the blank is glued to the edge of an opposite surface segment, resulting in four circumferential lateral surfaces of the cuboid. Surface segments connected by folding lines to these lateral surfaces of the cuboid form the cover and/or the base of the cuboid, which can be closed by folding along the folding lines.

In addition to their transport and protective function, such folding boxes sometimes also have a second use for presenting goods on the sales shelf. So-called "shelf-ready packaging" (SRP), for example, is used in the retail trade. Such packaging comprises a folding box of the type mentioned at the beginning, which is provided with a separate base part. The base part is designed to position goods accommodated in the folding box and is usually attached to the folding box with adhesive tape. Well-known designs of such a base part are corrugated cardboard blanks, deep-drawn parts of plastics or injection-molded trays. The SRPs usually have a perforation on the cardboard, which makes it possible to separate the top part so that the goods do not have to be removed from the SRP by the sales staff and the customer can access the goods directly. The SRPs are often referred to as secondary packaging in this context, as the goods are usually a primary packaged product. For example, toothbrushes today are always primary packaged in what is known as a blister pack. In retail, blister pack is the term used to describe visual packaging that allows the customer or buyer to see the packaged product. The product is usually presented in front of a cardboard back wall printed with information and is fixed with a plastic molding.

The previously known folding boxes need to be improved, since a base part for positioning goods must be manufactured separately, connected to the folding box and separated from it again for recycling.

SUMMARY OF THE INVENTION

The present invention is based on the problem of indicating an improved folding box made of cardboard, which consists of a single blank forming a cuboid and offers the possibility of positioning elements to be accommodated, in particular blister packs with toothbrushes, within a receiving space formed by the folding box.

To solve this problem, the present invention defines a folding box made of cardboard according to the principles described herein. This folding box consists of a blank, which forms four lateral surfaces, cover and base of a cuboid. Usually, recyclable cardboard with a cardboard weight of 200 to 800 g/m$^2$ is used as the starting material. The cardboard can be loaded with a layer of paper on one side. The blank is divided by four main folding lines into four main surfaces and one fastening surface. The main surfaces each comprise a main surface segment which, after fastening the fastening surface to an edge section of an opposite main surface, forms one of the usually circumferential lateral surfaces of the cuboid. The fastening surface is usually fully glued to an edge section of the opposite main surface. The blank comprises several secondary folding lines, of which a respective one of the secondary folding lines connects one of the main surface segments to an adjacent secondary surface segment. The secondary folding lines are arranged crosswise, usually orthogonal to the main folding lines. One or more of the secondary surface segments respectively form the cover and the base of the cuboid. The main folding lines and the secondary folding lines run correspondingly along the edges of the cuboid. With a folding box standing on the base, the main folding lines run vertically and the secondary folding lines horizontally.

The folding box according to the invention differs from the prior art in that at least one of the secondary surface segments has a multitude of parallel webs which enclose respective gaps between them. Furthermore, the secondary surface segment has a folding line running over the secondary surface segment orthogonally to the webs, in which the secondary surface segment can be folded in such a way that several receiving compartments protruding from the base side are formed within the folding box by the webs. The secondary surface segment is usually folded inwards at the folding line, i.e. in the direction of a receiving space defined by the main surface segments. Protruding at the base side is therefore defined in particular as an extension from the inside of the base towards the receiving space of the folding box. One receiving compartment each is assigned to each gap of the secondary surface segment. In particular, the receiving compartments are arranged in a row one behind the other or next to each other. A receiving compartment usually accommodates at least one edge region of a primary packaging containing a product, so that the product is positioned and held in the primary packaging by the receiving compartment within the folding box, which receiving compartment is delimited by two webs. Here, the receiving compartments are preferably dimensioned in such a way that the product or primary packaging can be inserted into a receiving compartment and held freely upright in it, in particular can be positioned in a form-fit manner.

The present invention simplifies the production of a folding box with positioning aids, since the folding box is formed in one piece from a single blank. The blank can be cut, folded and glued by machine. There is no need for an additional work step to attach a corrugated cardboard or a plastic part as a positioning aid. This also reduces material consumption, especially compared to the use of a plastic part. Furthermore, the folding box according to the present invention need not be separated for recycling.

An alternative solution suggested for the underlying problem is known from DE 39 05 776 A1.

To improve the positioning of products in primary packaging, the folding box according to the present invention has certain preferred proportions. These are given below in this paragraph. The length is the dimension of a flat element in the direction of the largest expansion direction and the width is the dimension in the direction orthogonal to the length.

Two opposite lateral surfaces of the cuboid or the main surface segments forming the folding box have the same length and the same width. The width of adjacent main surface segments preferably differs by a factor between 2.5 and 10.0. The factor is particularly preferred at 2.75 or 3.0 or 3.25. However, the main surface segments have the same length which corresponds to the height of the folding box standing on the base. The narrower main surface segments are preferably at least 2.5 times, particularly preferably at least 3.0 times, as long as wide. The length of the webs essentially corresponds to the length of the gaps. The width of the webs is preferably at least twice as large as the width of the gaps. The width of the webs is preferably less than or equal to ⅛ of the length of the secondary surface segment. The length of the webs is preferably at least 30%, further preferably 35%, and particularly preferably 38% of the width of the secondary surface segment.

The secondary surface segment which comprises the plurality of parallel webs, each enclosing gaps between them, is preferably formed onto one of the wider main surface segments. The gaps are usually interruptions in the secondary surface segment. Such interruptions are usually created by punching a continuous surface out of the cardboard or breaking it out along a perforation line. Usually, the interruptions are of an elongated nature with a certain gap width. The gap width is preferably smaller than half of the elongated extent of the interruption, especially preferably smaller than one third. However, the gap width need not be constant over the elongated extension of the interruption and may vary. The minimum gap width preferably corresponds to at least the smallest expansion of a blister pack containing at least one toothbrush and intended to be received in the folding box, in one direction of the space. Usually this smallest expansion of the blister pack is the thickness of the blister pack at the thinnest point. Preferably, the maximum gap width corresponds at most to the maximum thickness of a blister pack containing at least one toothbrush and intended to be received in the folding box. The longitudinal extension of the interruption preferably corresponds at most to the width of a blister pack containing at least one toothbrush and intended to be received in the folding box. The width of such a blister pack is generally defined as the extension in the direction of the second largest spatial expansion. The gaps are particularly preferably formed in such a way that a plastic molding of a blister pack containing at least one toothbrush and inserted into a receiving compartment is elastically pressed in by two webs enclosing a gap between them or that only a sealing edge of the blister pack is enclosed between two webs.

According to a preferred development of the present invention, the gaps are spaced by an outer strip from an edge of the blank and by an inner strip to a secondary folding line arranged between the main surface segment and the secondary surface segment comprising the gaps. The strips extend transversely to the length of the gaps and parallel to the secondary folding line. The length of the strips preferably corresponds to the length of the secondary surface segment. The inner strip and the outer strip preferably have the same width. This makes it possible to form the receiving compartments by simply folding surface segments. The fact that the gaps and the webs are surrounded on both sides by the cardboard strips and are thereby spaced from the edges of the secondary surface segment also improves the stability of the receiving compartments.

According to another preferred development of the present invention, the gaps are widened towards the outer strip. This means that the gap is wider at the outer strip than in the middle between the outer and inner strip. In particular, the gaps are trapezoidal at their end on the side of the outer strip. The gaps can often widen by at least 1.75 times as compared to the width at the middle of the gaps. The widening described above results, for example, in a conical opening of the receiving compartment in the direction of insertion from above into the receiving compartment towards the base and makes it easier to insert the primary packaging into the receiving compartments.

According to a preferred development of the invention, the inner strip forms the base at least partially and the outer strip rests on an inner surface of one of the main surface segments delimiting the receiving space within the folding box. This main surface segment is preferably the one that is connected via one of the secondary folding lines to the secondary surface segment comprising the strips. The outer strip lies on the inner surface of the main surface segment preferably without adhesive, especially over the entire surface. The adhesive-free contact makes it easier to produce the folding box, as there is no need for a gluing step. Adhesive material can also be saved and the folding box can be disposed of by type. The base of the folding box is usually formed by the inner strip and at least one further secondary surface segment, which overlap and preferably lie against each other when extending parallel, whereby the inner strip is located on the inside of the base. However, the base can also only be formed by the secondary surface segment comprising the gaps. Usually the inner strip forms the base. In particular, the inner strip is connected to the webs via the folding line. A first section of the webs then extends in the direction of the receiving space, usually along and parallel to the main surface segment opposite the main surface segment onto which the inner strip is formed. A second section of the webs connected to the first section via a second folding line extends within the receiving space preferably parallel to the inner strip and at a distance from the inner strip corresponding to the length of the first section of the webs. The second section of the webs usually merges into the outer strip which usually extends parallel to, and preferably adhesively bonded to, the main surface segment onto which the inner strip is formed.

According to another preferred development of the present invention, two auxiliary folding lines are provided along the connection of the strips with the webs. Thus the gaps are delimited in longitudinal direction on both sides by the auxiliary folding lines. The webs are free of kinks and preferably form—in the sectional view of the secondary surface segment comprising the webs and of the main surface segment provided adjacent and directly connected thereto, which extends parallel to the webs—a connection line between the secondary surface segment comprising the webs and the main surface segment connected thereto via one of the secondary folding lines. The connection point of this connection line with the inner strip in the sectional view is preferably spaced from the inner surface of the main surface segment by at least 10%, further preferably by at least 15%, of the width of the narrower secondary surface segment. In particular, the webs bridge the secondary folding line which connects the secondary surface segment comprising the webs to one of the main surface segments. This ensures that the outer strip lies securely against the inside of the main surface segment. If there is only one secondary surface segment with a multitude of gaps between enclosing parallel webs, the connection line preferably connects the two wider main surface segments usually in a line parallel to the base of the folding box.

Preferably the folding line runs on the inner strip and divides the inner strip into a first inner strip segment and a second inner strip segment, the first inner strip segment forming all or part of the base and being wider than the second inner strip segment. The second inner strip segment is connected to the first inner strip segment to form a double-layer section, preferably glued or put together. A detachable adhesive and/or glue connection is also possible. In particular, the two inner strip segments extend parallel to each other. Preferably, the first inner strip segment is at the most 2.5 times wider than the second inner strip segment. The double-layer section increases the stability of the receiving compartments and improves the preferably adhesive-free contact of the outer strip with the inner surface of the main surface segment.

According to another preferred development of the present invention, the folding box comprises two secondary surface segments formed at the base side on opposite lateral surfaces of the cuboid according to the above description or according to at least one of the developments mentioned above. The folding box in this development comprises two opposite rows of gaps, each aligned with one another, so that a receiving compartment is formed by two opposite gaps. A primary or blister pack can thus be held and/or positioned at the base of the folding box on both sides. Alternatively, two primary or blister packs may be accommodated side by side in one receiving compartment.

According to a preferred development of the present invention, the folding box comprises a tear tab. This tear tab runs around the main surface segments of the folding box. The tear tab is delimited by punching lines that only partially penetrate the cardboard. The punching lines only penetrate the cardboard to such an extent that the tear tab can be torn open effortlessly. By pulling on the tear tab, the folding box can be torn open, thereby separating the folding box into a part on the cover side and a part on the base side. The part on the cover side is usually removed and the part on the base side, in which the primary or blister packs are to be held, remains for product presentation. The tear tab is usually also provided on the fastening surface.

The tear tab is preferably interrupted in the circumferential direction by a recess in one of the main surface segments. In particular, the recess is provided in one of the wider main surface segments. This allows the tear tab to be gripped better. The recess is at least dimensioned in such a way that one, preferably two, fingers of a user fit into the recess in order to grip behind the tear tab.

According to another preferred development of the present invention, the tear tab at a narrow front face side of the folding box formed by a main surface segment is widened towards the base. In particular, the tear tab at the widening has a larger width than the otherwise essentially constant width of the tear tab. It is advantageous that when the tear tab is torn off, the widening forms a visible indent at the face side of the folding box, so that the customer can better see the primary or blister packs accommodated in the receiving compartments, especially those provided adjacent to the widening, when the folding box is placed on a sales shelf. The development makes it easier for the sales staff to check the filling level of the folding box. It goes without saying that the folding box is placed on the shelf in such a way that the narrower main surface segment with the widening of the tear tab is at the front of the shelf and the printing on the blister pack is visible through the widening.

According to a preferred development of the present invention, the tear tab is designed to run obliquely on opposite wide main surface segments, which interconnect two narrower main surface segments forming the face side and the back side of the folding box. In this case, obliquely means at an angle significantly greater than 0° to the main and secondary folding lines. A front narrower main surface segment between the base and the tear tab has a smaller extension than an opposite rear narrow main surface segment. The oblique course in the torn-off state of the tear tab encourages the customer to remove primary or blister packs, which are accommodated in the receiving compartments, from the front, narrower face side of the folding box, making it easier to check the filling level of the folding box. The preferred angle of the obliquely extending section of the tear tab to one of the secondary folding lines is 20-40°, and particularly preferably 22-30°.

In a secondary aspect, the present invention specifies a packaging unit for blister packs with a folding box according to the invention. In particular, the present invention focuses on blister packs containing toothbrushes. Each blister pack in the packaging unit according to the present invention is received in one of the receiving compartments. The receiving compartments allow an orderly and efficient arrangement of the blister packs in the folding box. The blister packs stand on the base. In particular, the blister pack is held free-standing in one of the receiving compartments so that the stability of the positioning of the blister pack does not depend on the number of blister packs contained in the packaging unit. This means that the position of the blister packs in the folding box is essentially not changed by removing a single blister pack. A blister pack is usually considered to have been received in a receiving compartment if it is inserted with at least one edge region into one of the gaps between two webs. In most cases, the edges of the webs form a form-fit boundary for the blister pack.

In one aspect of the method, the present invention describes a method for producing a folding box made of cardboard, consisting of a cardboard blank forming four lateral surfaces and the cover and base of a cuboid and comprising four main folding lines dividing the blank into four main surfaces and a fastening surface. The fastening surface is fastened to the opposite main surface so that one main surface segment each of the main surfaces forms one of the lateral surfaces of the cuboid. The cardboard blank comprises secondary folding lines running transversely to the main folding lines, of which one secondary folding line each connects one of the main surface segments to a secondary surface segment. The base and the cover of the cuboid are formed by folding along one or more secondary folding lines of one or more of the secondary surface segments. At least one of the secondary surface segments comprises a plurality of gaps between enclosing parallel webs and a folding line running over the secondary surface segment orthogonally to the webs, in which the secondary surface segment is folded in such a way that the webs form a plurality of receiving compartments protruding from the base side within the folding box.

The method according to the invention is comparatively simple and is particularly suitable for machine implementation. Thus the manufacturing costs can be reduced. Since no separate base inserts have to be used, the folding box can also be disposed of or recycled more easily later.

According to a preferred development of the method according to the invention, the secondary surface segment, which has a large number of gaps between enclosing parallel webs and a folding line running orthogonally to the webs over the secondary surface segment, is folded in such a way that it forms a double-layer section at the base of the folding box.

This allows, on the one hand, the base of the folding box to be made stable and prevents, on the other hand, the webs from taking up an unnecessarily large space at the base of the folding box.

According to a further preferred development of the method according to the invention, the secondary surface segment, which comprises a plurality of gaps between enclosing parallel webs and a folding line running orthogonally to the webs over the secondary surface segment, is folded in such a way that it rests with an outer strip on an inner surface of one of the main surface segments delimiting a receiving space within the folding box. Preferably, the main surface segment is the one that is connected to the secondary surface segment via a secondary folding line.

This ensures a stable alignment of the webs which extends obliquely within the folding box.

BRIEF DESCRIPTION OF THE DRAWINGS

Further details and advantages of the present invention become apparent from the following description of two embodiments of a folding box and one embodiment of a packaging unit in connection with the drawing. In this drawing.

DETAILED DESCRIPTION OF THE INVENTION

Figure 1:
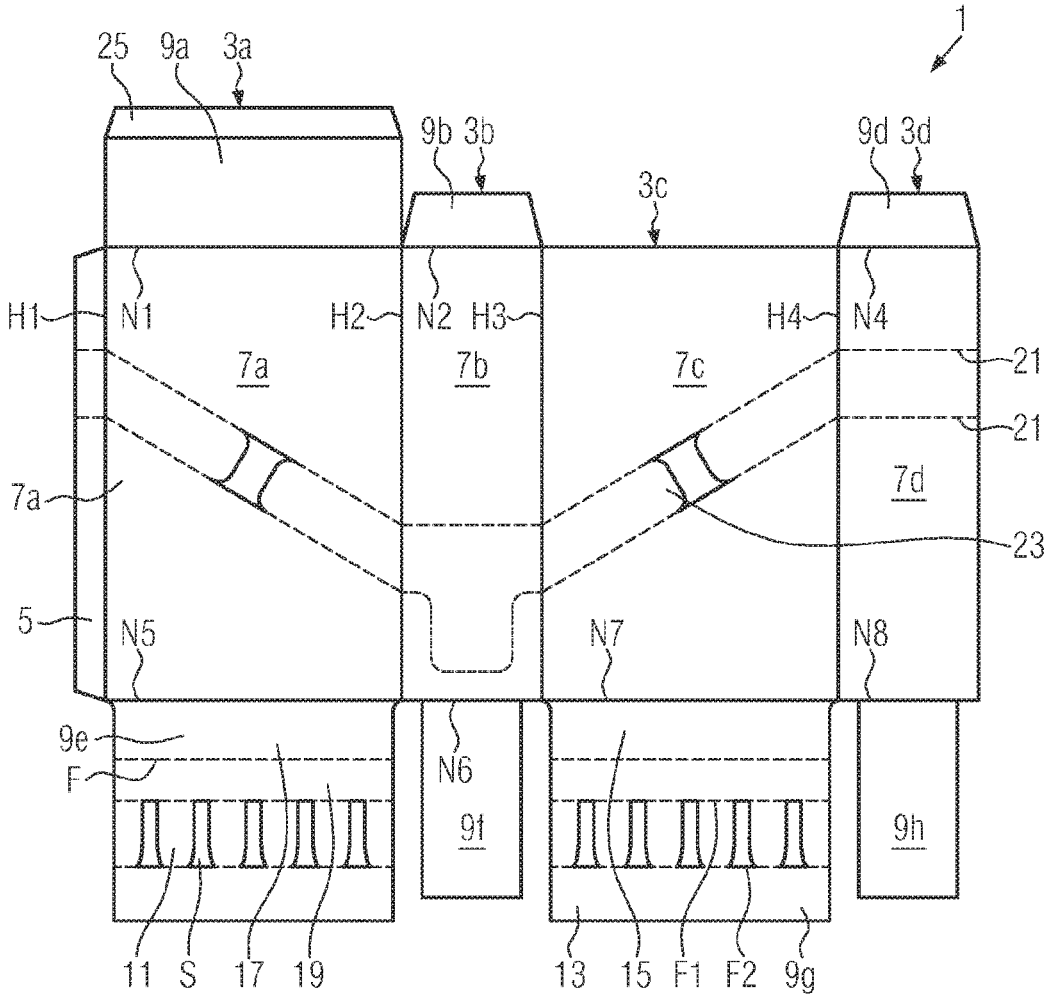
FIG. 1 shows a top view on the blank of a first embodiment of a folding box.

Using FIG. 1, details of the blank 1 used for an embodiment of a folding box are explained below. This blank is divided into four main surfaces 3*a*, 3*b*, 3*c*, 3*d*, which are folded at the main folding lines H2, H3, H4 at a 90° angle to each other. A fastening surface 5 is connected via a main folding line H1 to the main surface 3*a*, which forms a fastening tab 25 at the end side. The fastening surface 5 is also folded by 90° and glued to the edge of the main surface 3*d* in such a manner that four lateral surfaces of a cuboid are formed by four main surface segments 7*a*, 7*b*, 7*c*, 7*d* of the main surfaces 3*a*, 3*b*, 3*c*, 3*d*. Thus the opposite main surface segments have the same width and the same length. The main surface segments 7*a*, 7*b*, 7*d* are connected via secondary folding lines N1, N2, N4 to secondary surface segments 9*a*, 9*b*, 9*d*, which form the cover of the folding box. For this purpose, first the secondary surface segments 9*b*, 9*d* and then the secondary surface segment 9*a*, which is provided with the fastening tab 25, are folded by 90°. The fastening tab 25 is then pushed into the folding box past the edges of the secondary surface segments 3*b*, 3*d*. At the base side, the main surface segments 7*a*, 7*b*, 7*c*, 7*d* are connected via the secondary folding lines N5, N6, N7, N8 to a respective secondary surface segment 9*e*, 9*f*, 9*g*, 9*h*. The secondary surface segments 9*e*, 9*g* connected to the opposite wider main surface segments 7*a*, 7*c* comprise multiple gaps S in the form of perforations which are delimited by webs 11 and an inner strip 15 and an outer strip 13. The strips 13, 15 run parallel to the secondary folding lines N5, N7. The longitudinal extension of the webs 11 and the gaps S, on the other hand, is orthogonal to the secondary folding lines N5, N7.

The inner strip 15 is further divided by the folding line F into a first inner strip segment 17 and a second inner strip segment 19, the first inner strip segment 17 being wider than the second inner strip segment 19. The secondary surface segments 9*e*, 9*f*, 9*g*, 9*h* are folded by 90° at the secondary folding lines N5, N6, N7, N8, whereby the secondary surface segments 9*e*, 9*g* are folded chronologically before the secondary surface segments 9*f*, 9*h*, so that the secondary surface segments 9*e*, 9*g* are superimposed on the outside by the secondary surface segments 9*f*, 9*h*. By folding by 180° in the direction of the receiving space along the folding line F and gluing the second inner strip segment 19 to the first inner strip segment 17, a plurality of receiving compartments formed by the webs are formed within the folding box. The auxiliary folding lines F1, F2, which run along the connection lines of the webs 11 with the strips 13, 15, ensure that the webs 11 remain free of kinks and that the outer strip 13 is fully in contact with the inner surface of the main surface segment 7*a* or 7*c* with a certain pretension and free of adhesive. Usually, the two secondary surface segments 9*f*, 9*h* are connected to the first two inner strip segments 17 on the outside with an adhesive tape in order to increase the stability of the base of the folding box.

The gaps S are trapezoidal in shape at their end pointing towards the outer strip 13, resulting in a widening of the gaps in the direction of the outer strip 13. When the folding box is standing on the base (see FIG. 2), the gaps S form a row of receiving compartments A1, A2, A3, A4 arranged one behind the other or side by side. The receiving compartments A1, A2, A3, A4 have an insertion opening which is widening and opening upwards in vertical direction due to the widening of the gaps S, which makes it easier to insert blister packs containing at least one toothbrush. The insertion openings are formed in close proximity to the inner surface of the main surface segment 7*a*.

The main surface segments 7*a*, 7*b*, 7*c*, 7*d* and the fastening surface 5 are provided with punching lines 21 which only partially penetrate the cardboard. These lines completely encircle the cuboid in the width direction of the main surface segments. The punching lines 21 delimit a first tear tab 23 and a second tear tab 24 between them. The tear tab 23 is provided at the main surface segment with a widening which is defined by a U-shaped loop of the lower punching line 21. The punching lines 21 run obliquely on the wider main surface segments 7*a*, 7*c*, i.e. at an angle to the secondary folding lines N5, N7. In the present embodiment, this angle is 22.5°. As a result, the distance between the punching lines 21 on the main surface segment 7*d* and the secondary folding line N8 is greater than the distance between the punching lines 21 on the main surface segment 7*b* and the secondary folding line N6. On the main surface segment 7*d* and the fastening surface 5, the punching lines 21 run parallel to the secondary folding line N8.

Figure 2:
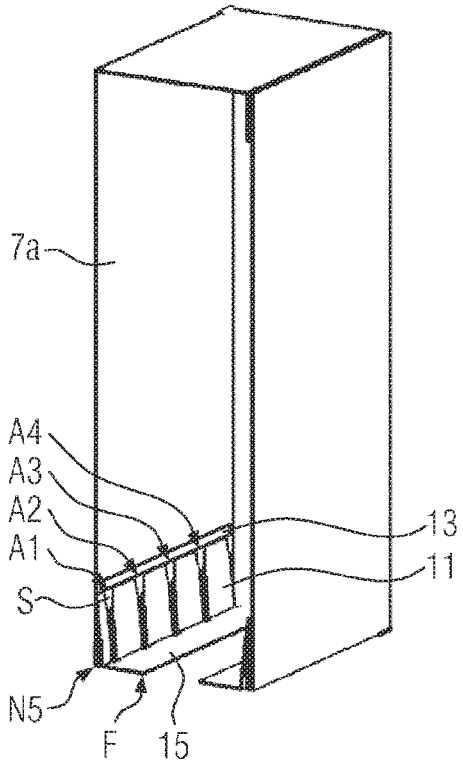
FIG. 2 shows a perspective sectional view of the folding box formed from the blank of FIG. 1.

FIG. 2 shows a perspective sectional view of the folding box formed from the blank according to FIG. 1. The outer strip 13 is fully in contact with the inner surface of the main surface segment 7*a*. The second inner strip segment 19 is folded by 180° at the folding line F and glued on the inside of the first inner strip segment 17 to said segment. Just as well, the two inner strip segments 17, 19 can also be put together instead of being glued. The putting together can be performed in the usual way, e.g. by way of a receiving slot in the one inner strip segment in which a tab formed by the other strip segment engages. The webs 11 run by bridging the secondary folding line N5 along an oblique connection line which connects the base of the folding box to the inner surface of the main surface segment 7*a*. One receiving compartment A1, A2, A3, A4 each is formed by one of the gaps S.

Figure 3:
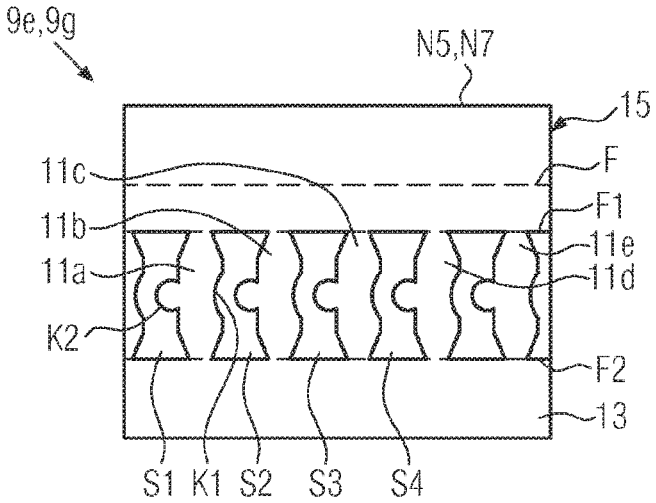
FIG. 3 shows a top view on a secondary surface segment of a second embodiment.

FIG. 3 shows a top view on a secondary surface segment 9*e*, 9*f* of a second embodiment. In this embodiment, the gaps S1, S2, S3, S4 also have a trapezoidal widening at their end in the direction of the inner strip 15. The webs 11*a*, 11*b*, 11*c*, 11*d*, 11*e* have an outer contour K1, K2 in the form of a segment of a circle on both sides at the height of their center. The curvature of the outer contour K1 is negative (concave) and the curvature of the outer contour K2 is positive (convex). This means that the contour K1 forms an indentation in the web S1 and the contour K2 forms a bulge in the web S1. In terms of amount, the curvature of the contour K1 is greater than that of the contour K2. The contours K1, K2 of the webs are here matched to each other in such a way that the gaps S1, S2, S3, S4 form an annular section in longitudinal direction at the height of their center. The gaps S1, S2, S3, S4 thus have a serpentine shape, whereby the blister pack inserted into a receiving compartment is carried at at least three points and the holding effect is intensified. With this embodiment, the gaps S1, S2, S3, S4 are designed in such a way that a blister pack inserted with its sealing edge 27 into one of the gaps S1, S2, S3, S4 can be held free-standing in a receiving compartment A1, A2, A3, A4.

Figure 4:
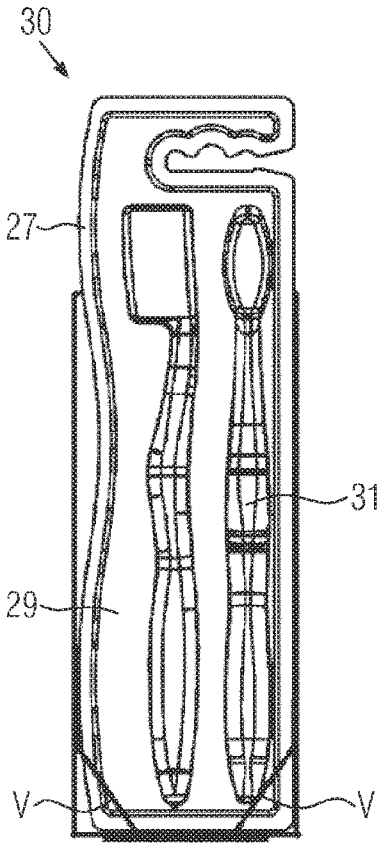
FIG. 4 shows a frontal view of a blister pack held in a receiving compartment and containing two toothbrushes.

FIG. 4 shows a frontal view of a blister pack held in a receiving compartment A1, A2, A3, A4 according to the first embodiment. The blister pack comprises a plastic molding 29 which fixes two toothbrushes 31 to a cardboard back wall. A sealing edge 27, on which the plastic molding 29 is pressed onto the cardboard back wall, seals the toothbrushes 31. The connection line V runs over the plastic molding 29 and the sealing edge 27.

Figure 5:
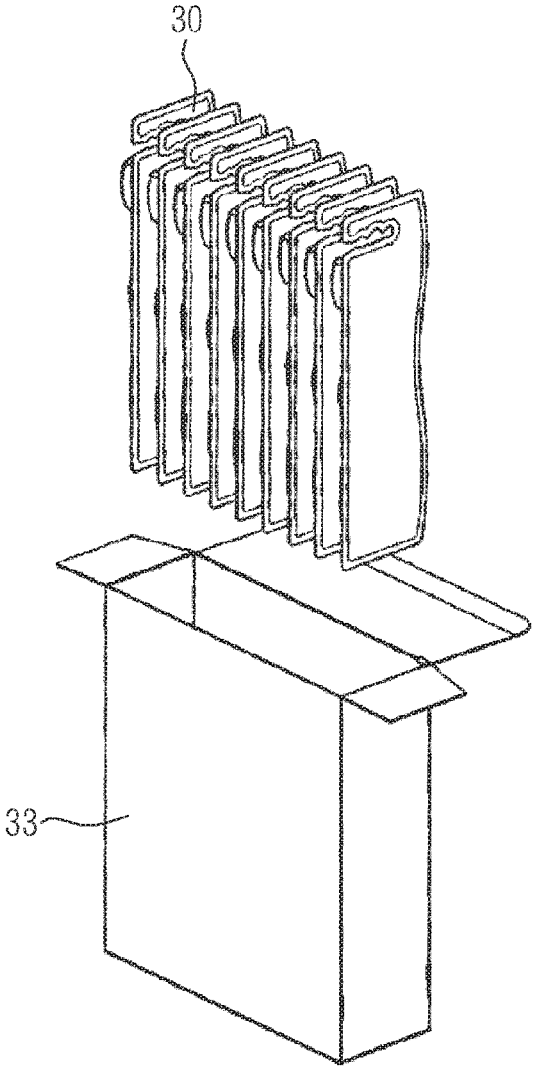
FIG. 5 shows a perspective side view of an embodiment of a packaging unit composed of blister packs containing toothbrushes and of a folding box.
Figure 6:
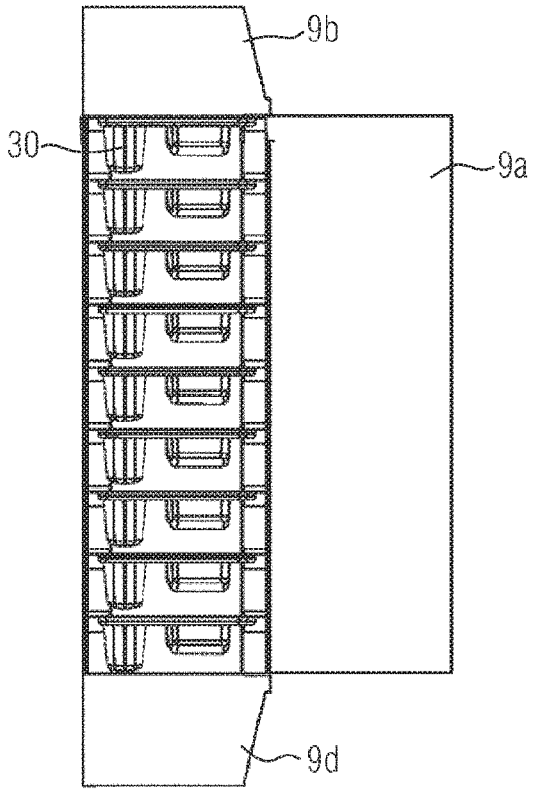
FIG. 6 shows a top view on the packaging unit from FIG. 5 in the filled state.

FIG. 5 and FIG. 6 show an embodiment of a packaging unit formed by inserting a row of toothbrushes 31 into the folding box 33. The insertion takes place in an automated manner from top to bottom through the open cover of the folding box 33. The top view of FIG. 6 with the cover of the filled folding box 33 in the open state shows that the individual toothbrushes 31 are held free-standing in the folding box 33.

Figure 7:
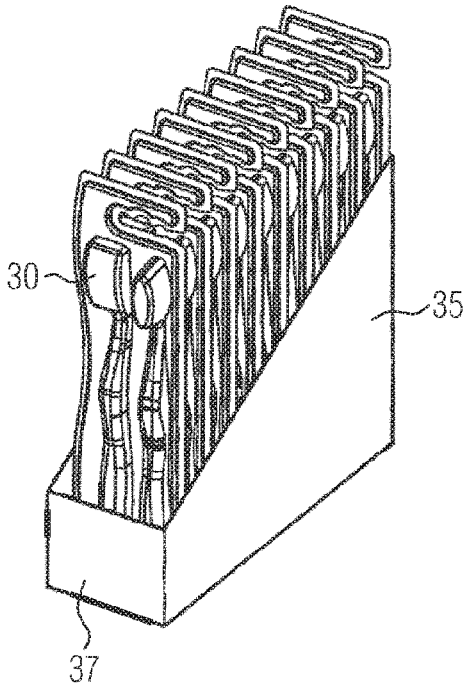
FIG. 7 shows a perspective side view of a packaging unit with the tear tab torn off.

FIG. 7 shows the packaging unit with the tear tab 23 torn off. The toothbrushes 31 remain in the base-side part 35 of the two parts created by tearing off the tear tab 23. The part of the folding box 33 on the cover side has been removed. The packaging unit is intended to be placed on a sales shelf after tearing off the tear tab 23 and removing the part on the cover side. The back side of the base-side part is higher than the face side 37. The face side 37 is arranged on the visible side of the shelf so that a customer standing in front of the shelf can clearly see the toothbrushes 31. The blister packs are placed in the receiving compartments with the plastic molding 29 pointing in the direction of the face side 37.

Figure 8:
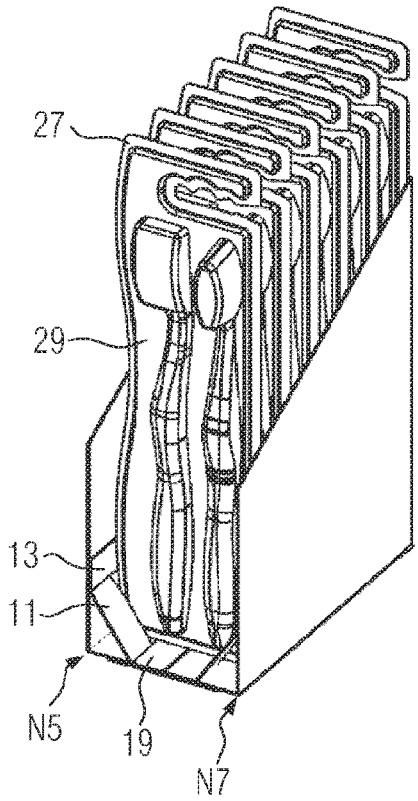
FIG. 8 shows a sectional view of the packaging unit shown in FIG. 7.

FIG. 8 is a sectional view of the packaging unit shown in FIG. 7. The webs 11 run on the base of the folding box in two rows, whereby one row at a time encloses one of the two lower corners of the blister packs. The one row bridges the secondary folding line N5 and the other row bridges the secondary folding line N7.

LIST OF REFERENCE NUMERALS

1 blank
3*a*, 3*b*, 3*c*, 3*d* main surfaces
5 fastening surface
7*a*, 7*b*, 7*c*, 7*d* main surface segment
9*a*, 9*b*, 9*d*, 9*e*, 9*f*, 9*g*, 9*h* secondary surface segment
11, 11*a*, 11*b*, 11*c*, 11*d*, 11*e* web
13 outer strip
15 inner strip
17 first inner strip segment
19 second inner strip segment
21 punching line
23 first tear tab
24 second tear tab
25 fastening tab
27 sealing edge
29 plastic molding
30 blister pack
31 toothbrush
33 folding box
35 base-side part
37 face side
A1, A2, A3, A4 receiving compartment
H1, H2, H3, H4 main folding line
N1, N2, N4, N5, N6, N7, N8 secondary folding line
F1 folding line
F1, F2 auxiliary folding line
S, S1, S2, S3, S4 gap
V connection line

The invention claimed is:

1. A folding box made of cardboard, comprised of a folded blank which forms four lateral surfaces and a cover and base of a cuboid, the folded blank comprising:

four main folding lines which divide the blank into four main surfaces and a fastening surface, wherein each of the main surfaces comprises a main surface segment, which forms a respective lateral surface of the cuboid after fastening of the fastening surface to the opposite main surface, and multiple secondary folding lines, which run transversely to the main folding lines and each of which connects one of the main surface segments to a secondary surface segment, wherein each of one or more of the secondary surface segments forms the cover and the base of the cuboid, at least one of the secondary surface segments comprises a plurality of gaps between enclosing parallel webs and a folding line which runs over the secondary surface segment orthogonally to the webs and in which the secondary surface segment can be folded such that multiple receiving compartments that protrude from the base side are formed by the webs within the folding box, the gaps are spaced by an outer strip from an edge of the blank and by an inner strip to a secondary folding line arranged between the main surface segment and the secondary surface segment comprising the gap, the strips extend transversely to a main extension direction of the gaps and parallel to the secondary folding line, the gaps are made wider towards the outer strip and have a serpentine shape, and two auxiliary folding lines run along the connection of the strips with the webs.

2. The folding box according to claim 1, wherein the inner strip at least partially forms the base and that the outer strip rests on an inner surface of one of the main surface segments defining a receiving space within the folding box.

3. The folding box according to claim 1, wherein the folding line extends on the inner strip and the folding line divides the inner strip into a first inner strip segment and a second inner strip segment, wherein the first inner strip segment completely or partially forms the base and is wider than the second inner strip segment, which is connected, in particular glued or put together, with the first inner strip segment.

4. The folding box according to claim 1, wherein two identical secondary surface segments each comprising the plurality of gaps are formed at the base side on opposite lateral surfaces of the cuboid.

5. The folding box according to claim 1, further comprising a tear tab which is delimited by punching lines penetrating the cardboard only partially and which is provided on the main surface segments to surround the folding box.

6. The folding box according to claim 5, wherein the tear tab is widened towards the base at a narrow front face side of the folding box formed by a main surface segment.

7. The folding box according to claim 5, wherein the tear tab is formed to extend obliquely on opposite wide main surface segments interconnecting two narrower main surface segments forming the face side and the back side of the folding box, wherein a front narrower main surface segment between the base and the tear tab has a smaller extension than an opposite rear narrow main surface segment.

8. A packaging unit comprising the folding box according to claim 1 and blister packs containing toothbrushes, wherein each blister pack is received free-standingly in one of the receiving compartments of the folding box.

* * * * *